United States Patent [19]

Hansen

[11] Patent Number: 4,665,286

[45] Date of Patent: May 12, 1987

[54] MOTOR STARTING AND AUTOMATIC REVERSING SWITCH

[75] Inventor: John M. Hansen, Kansasville, Wis.

[73] Assignee: Emerson Electric Co., St. Louis, Mo.

[21] Appl. No.: 835,627

[22] Filed: Mar. 3, 1986

[51] Int. Cl.[4] ..... H01H 35/10

[52] U.S. Cl. ..... 200/80 R; 310/68 E; 73/545

[58] Field of Search ..... 310/68 E; 200/80 R, 200/245, 246, 239, 240, 241, 283, 290, 16 BB, 16 C; 73/535, 538, 545, 548, 550; 318/462, 473; 307/120

[56] References Cited

U.S. PATENT DOCUMENTS

| | | | |
|---|---|---|---|
| 2,673,272 | 3/1954 | Frey | 200/80 R |
| 2,683,844 | 7/1954 | Schaefer | 318/207 |
| 2,701,855 | 2/1955 | Hammes | 200/80 R |
| 2,850,592 | 9/1958 | Wieczorek | 200/80 R |
| 3,157,762 | 11/1964 | Seely | 200/80 R |

*Primary Examiner*—G. P. Tolin

*Attorney, Agent, or Firm*—Fuller, Puerner & Hohenfeldt

[57] ABSTRACT

A single phase induction motor starting and automatic reversing switch has two pairs of springy vertically spaced apart switch blades supported in opposed cantilever fashion on an insulating base. Each pair consists of an upper blade and a lower blade. A nominally stationary contact is mounted in spaced relation above each upper blade and below each lower blade. Opposite ends of the motor starting winding are connected in common between the upper and lower stationary contacts. A shaft of insulating material with a lever at one end operates the switch. The shaft extends between the vertically spaced apart blade pairs and has axially displaced oppositely radially extending arms, one between one pair of blades and the other between the other set of blades. Turning the operator shaft in a first direction causes one arm to press a blade against one upper stationary contact and the other arm to press a blade against one lower contact. Turning the shaft in a second direction causes the other blades in each pair to contact stationary contacts to change the current flow direction through the starting winding. A centrifugal force responsive device on the motor shaft actuates the switch operator.

8 Claims, 12 Drawing Figures

MOTOR STARTING AND AUTOMATIC REVERSING SWITCH

BACKGROUND OF THE INVENTION

This invention relates to a switch for controlling the starting and automatic reversing of single phase induction motors such as might be used, for example, and not limitation, to drive a garbage disposer unit.

Switches that start single phase induction motors and reverse the rotation of the motors if the rotor shaft drops below a predetermined speed due to an overload or comes to a stop are known in the prior art. Automatically reversing motors are especially desirable to drive garbage disposers in which a jam-up can often be cleared by simply reversing the rotational direction of the motor. Switches for starting and automatically reversing single phase induction motors are described in U.S. Pat. Nos. 2,673,272, 2,683,844, 2,701,855, 2,850,592 and 3,157,762 for example. Most currently available reversing switches are either electronic devices which are costly or some sort of friction activated devices which are known to be not as reliable as they ought to be.

SUMMARY OF THE INVENTION

The present invention features a switch that can start and automatically reverse an induction motor that has one start winding; that can be changed from a reversing switch to a starting switch by simply eliminating some parts; that has parts which are common for reducing the number of different parts; that has parts which are designed to permit overtravel to thereby eliminate the need for accurate control of tolerances of the assembled parts and that enhances reliability by employment of the simple mechanical motion of a reversely tiltable switch operating lever in combination with a centrifugally controlled rotating actuator.

Briefly stated, the new switch cooperates with an actuator comprised of a disc that fits over the shaft of the motor to rotate with the shaft and shift axially of the shaft. A device is mounted on the shaft and responds to changes in centrifugal force due to the motor stopping or slowing to below a predetermined rotational speed to shift the actuator disc from one position to another to thereby operate the starting and reversing switch. The new switch is comprised of a generally planar base member composed of an insulating material. Laterally spaced apart pairs of deflectable flat spring contact blades are mounted to the base member. The blades in each pair are superimposed and mounted in cantilever fashion so that their free ends can be deflected. Electrically connected stationary contact elements are supported from the base member in the line of movement of the deflectable spring blades. An insulating operator comprised of a shaft with an operating lever at one end and diametrically opposite and spaced apart radially extending arms on the shaft being disposed between the pairs of springy, deflectable blades operates the the starting and reversing switch. The lever on the operator shaft is arranged in alignment with the actuator disc whose axial position on the shaft is governed by a centrifugal device responsive to motor speed. When the motor coasts to a stop due to having the power mains switch opened or when it slows down due to the drag of an overload, the disc while rotating wipes against the lever on the shaft and turns the shaft through a limited angle. The radially extending arms on the operator shaft then rotate and push a blade from one pair into contact with its cooperating stationary contact and a blade from the other pair into contact with its cooperating stationary contact to provide current flow in one direction through the contacts and the starting winding so as to cause the rotor of the motor to turn in one direction. When the power mains switch is opened or when the rotor loses speed because of an overload on the motor, the disc shifts again and wipes against the operator shaft lever to rock the shaft in the opposite direction. The arms on the shaft then force the opposite blades in each pair of blades to contact their cooperating stationary contacts. This results in the direction of current flow through the starting winding relative to the direction through the running winding to be opposite of the starting winding current direction during the first occasion to thereby to cause the motor to reverse its rotational direction. The starting and reversing switch is supplied from the power mains through a switch which, when closed, immediately connects the running winding of the motor across the power lines. When the motor is up to normal speed the operator shaft is forced into neutral position by the springy blades and the starting circuit switches remain open.

A more detailed description of a preferred embodiment of the invention will now be described in reference to the drawings.

DESCRIPTION OF A PREFERRED EMBODIMENT

Figure 2:
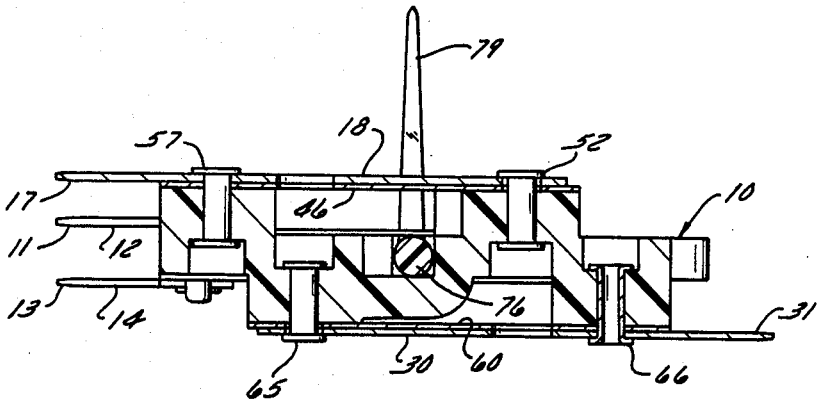
FIG. 2 is a vertical section taken on a line corresponding to 2–2 in FIG. 1.

In the following description and claims relative terms such as top, bottom, vertical, horizontal, up and down are used. Such terms are nominal and are used for the convenience of the reader and to facilitate location of the parts in the drawings used to depict the new motor starting and reversing switch. It should be evident, however, that the switch can be used in any orientation or attitude since its function is completely independent of gravity.

Figure 1:
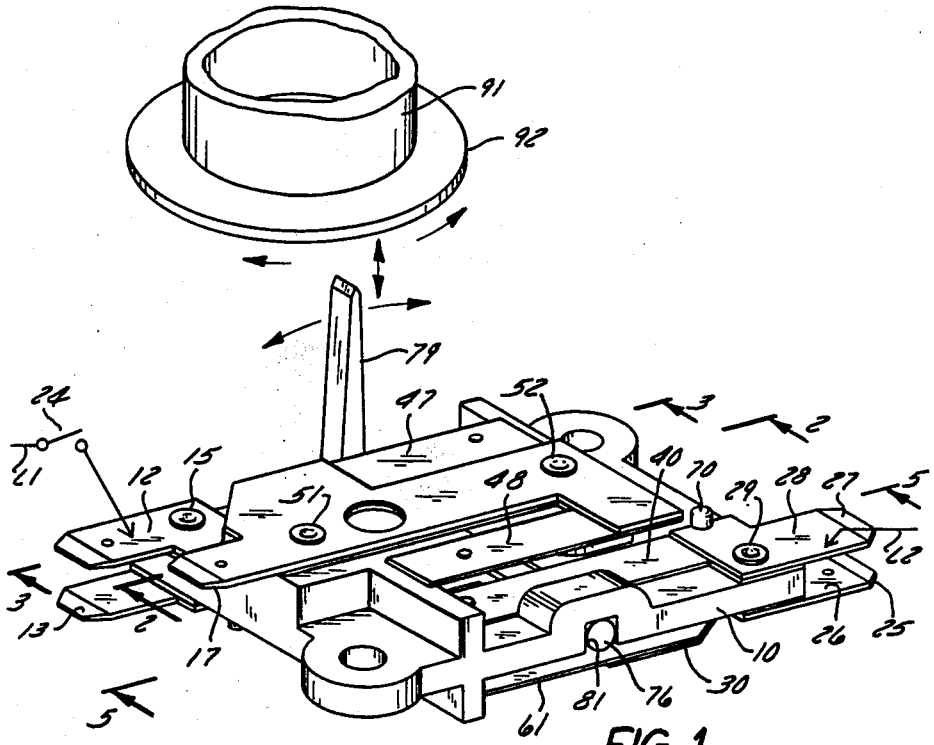
FIG. 1 is a perspective view of the new starting and reversing switch assembly in conjunction with the rotating disc that actuates it.
Figure 6:
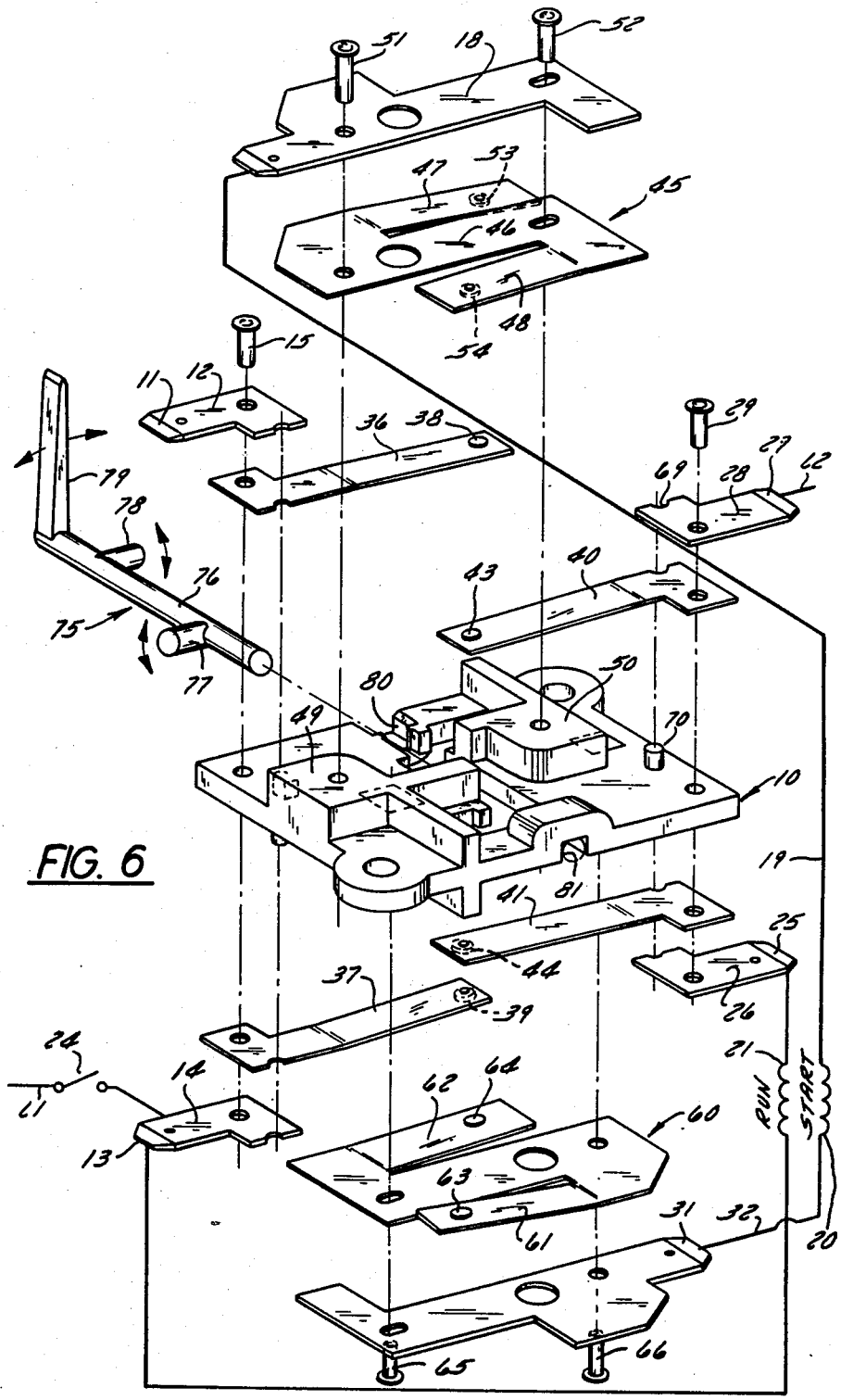
FIG. 6 is a perspective exploded view of the switch depicted in FIG. 1.

Attention is now invited to FIGS. 1 and 6 wherein one may see that the new switch comprises a base member 10 composed of a rigid insulating plastic material. The electrical conducting elements and support members arranged on the top surface of base member 10 are mirror images of those on the bottom surface. All of the elements shown in FIGS. 1 and 6 are used when the switch is used for controlling the starting winding of the motor and for reversing the motor but one of the sets of elements on the top or the bottom of the base member can be removed if it is desired to simply use the switch for starting a single phase motor that is to run in the same direction each time it is energized.

Conductors, not shown in FIG. 1 but shown in other figures, leading from the power mains and to the starting and running windings of the ac induction motor are connected to the switch with spade connectors. Spade connector 11 has one of the power lines L1 connected to it. There is a manually operated single pole main switch 24 in the power line. Spade connector 11 is part of a stiff flat metal conducting support plate 12. Spade connector 13 is also connected to the power line and is part of a stiff conducting support plate 14. As can be seen in FIG. 6, spade connectors 11 and 13 are at the top and bottom of base member 10 and are electrically connected by means of an eyelet 15 which is flared or staked at both ends. Rivets could be used in place of eyelets. Spade connector 17 is part of a support plate 18 which resides at the top of base member 10. As shown diagrammatically in FIG. 6, spade connector 17 connects to a conductor 19 leading to one end of the motor starting winding 20.

The second side of the power mains, L2, connects to either of spade connectors 25 on plate 26 or connector 27 on plate 28. The motor running winding 21 is connected permanently between connector 14 which connects to line L1 and connector 26 which connects to line L2. The eyelet 29 which mounts plates 26 and 28 to base 10 also connects plates 26 and 28 electrically. There is a rigid support plate 30 which is integral with spade connector 31 which connects by way of line 32 to one end of starting winding 20. As can be seen best in FIG. 6, there are two pairs of flat switch blades arranged parallel to each other and laterally spaced from each other. One pair of blades is comprised of top switch blade 36 and bottom switch blade 37. Switch blades 36 and 37 fasten to the top and bottom, respectively, of base member 10 where they become connected in common to single rigid support plates 12 and 14 by means of eyelet 15. Blades 36 and 37 in one pair are thus mounted in cantilever fashion and are superimposed but spaced apart from each other by at least the thickness of the base member in the region where they are fastened. Blades 36 and 37 are springy and deflectable and typically composed of beryllium copper. Near the free end of each of the blades 36 and 37, there is an electric contact element 38 and 39 which are desirably composed of silver cadmium oxide alloy. A corresponding pair of cantilever supported switch blades 40 and 41 are mounted to the top and bottom of base member 10 laterally spaced from and in parallel with blades 36 and 37. Blades 40 and 41 are similarly spaced apart by at least the thickness of base member 10 where they are mounted. They are electrically interconnected with connector plates 26 and 28 by means of eyelet 29. These blades are provided with contact elements 43 and 44 at their free ends. They are composed of the same material and have the same properties as blades 36 and 37.

At the top of the base member, there is a double flat spring blade member which is generally identified by the reference numeral 45. This is a double bladed member made of the same material as blade 36, for instance. Double blade member 45 has a flat central region 46 on which it is mounted and two unitary oppositely extending flexible blade members 47 and 48. As can be seen in FIG. 6, double blade member 45 is mounted to base member 10 on its upstanding bosses 49 and 50 by means of eyelets 51 and 52. The remote ends of deflectable blades 47 and 48 of double blade member 45 are provided with contact elements 53 and 54.

When the switch is assembled, contact 53 of double blade element 45 is arranged over contact 38 of single blade 36 and there is a space between single blade 36 and blade 47 so their contacts 38 and 53 are not normally in contact. The other blade portion 48 of double blade member 45 is arranged over and in spaced relationship with single blade 40 so the contact element 54 on double blade element 48 and contact element 43 on the single blade 40 are aligned with each other and spaced apart. It will be evident that single blade 36 can be pushed upwardly for its contact element 38 to make a resilient contact with contact element 53 on blade 47 on the double blade member 45. Similarly, it will be evident that blade 40 which is laterally spaced and oppositely directed from blade 36 can be deflected upwardly for its contact element 43 to make a resilient contact with contact element 54 on blade 48 of the double blade member 45.

The arrangement of the parts at the bottom of base member 10 is similar to the arrangement on top which was just described. At the bottom, there is another double blade member 60 having individual deflectable blades 61 and 62 on which there are contact elements 63 and 64. When the switch is assembled but unactuated, single blade element 41 is superimposed over blade 61 on double blade member 60 and contact elements 44 and 63 are in alignment. Also, single blade element 37 is superimposed over blade 62 of the double blade member 60 and contact elements 39 and 64 are in alignment but spaced apart. Thus, blade 37 can be deflected for its contact element 39 to make resilient contact with contact element 64 on blade 62 of double blade member 60. Similarly, single blade 41 can be deflected for its contact element 44 to make resilient contact with contact element 63 on blade 61 of double blade member 60. Double blade member 60 is secured to bosses on the bottom of base member 10 under the compressive force of stiff member 30 which is held by two eyelets 65 and 66 to base member 10. Most of the flexible blades and rigid supports, single blade 40 and stiff support 28 for example, have notches such as the one marked 69 for engaging with bosses such as the one marked 70 to keep the parts in alignment.

Figure 3:
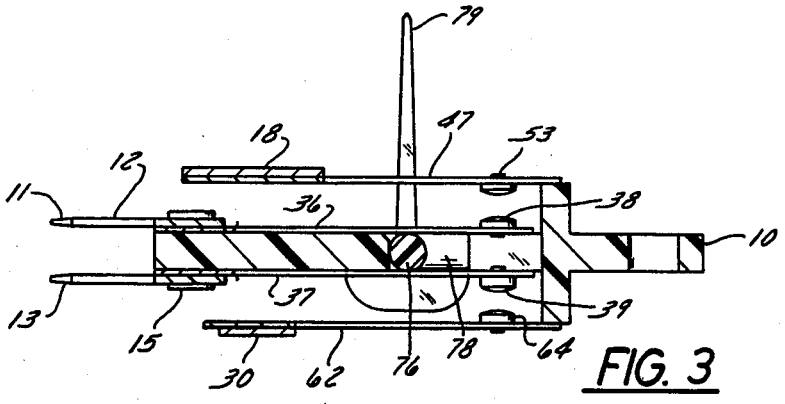
FIG. 3 is a vertical section taken on a line corresponding to 3–3 in FIG. 1, showing the starting circuits switch blades in non-conductive condition as would be in the case when the motor shaft is up to operating speed so the starting winding of the motor would be deenergized.
Figure 4:
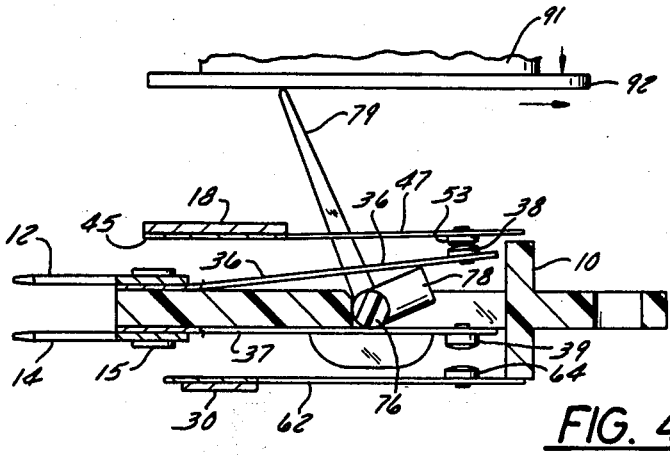
FIG. 4 is a section structurally similar to FIG. 3 but showing the operator shaft lever angulated in one direction to close one set of contacts and establish current flow in one direction in the starting winding of the motor.

The starting and motor reversing functions are achieved with a switch operator which appears in isolation in FIG. 6 and is generally designated by the numeral 75. Operator 75 is composed of a rigid plastic insulating material and comprises a shaft 76, oppositely radially extending arms 77 and 78 and an operating lever 79. Shaft 76 of the switch operator is set in recesses 80 and 81 in base member 10 for rotating through a limited angle. When the shaft is in place, radially extending arm 78 is disposed between the top single switch blade 36 and the bottom single switch blade 37 which is easier to see in FIG. 3. In FIG. 3 the operator is unactuated and in neutral position and it will be evident that if switch operator lever 79 is pushed at its tip to the left, shaft 76 will rotate counterclockwise as will radially extending arm 78 in which case single blade 36 at the top of base member 10 will be deflected toward the flexible blade portion 47 of double blade member 45 such that circuit continuity will be established by reason of contact elements 38 and 53 coming into contact as illustrated in FIG. 4. Considering FIG. 3 again, it will be evident that if operating lever 79 is rotated clockwise, the radial arm 78 will turn correspondingly and put contact elements 39 and 64 into contact.

Figure 5:
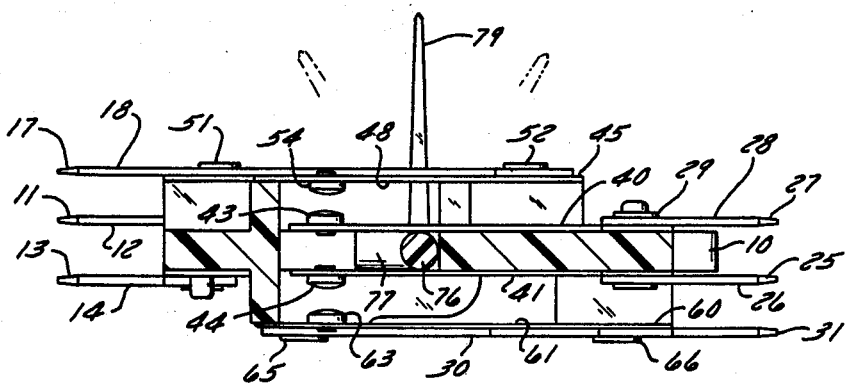
FIG. 5 is a vertical section taken on a line corresponding 5–5 in FIG. 1.

FIG. 5 shows how the other radially extending arm 77 of the switch operator is disposed between top single blade 40 and bottom single blade 41. In this case, if operating lever 79 is pushed counterclockwise as was the case in FIG. 4, radially extending arm 77 in FIG. 5 will deflect blade 41 and put the contact element 44 on single blade 41 into contact with contact element 63 on one blade 61 of double blade member 60. If the switch operator 79 is swung clockwise, upper single blade 40 will be deflected such that its contact element 43 will come into contact with contact element 54 on double blade member 45.

Figure 7:
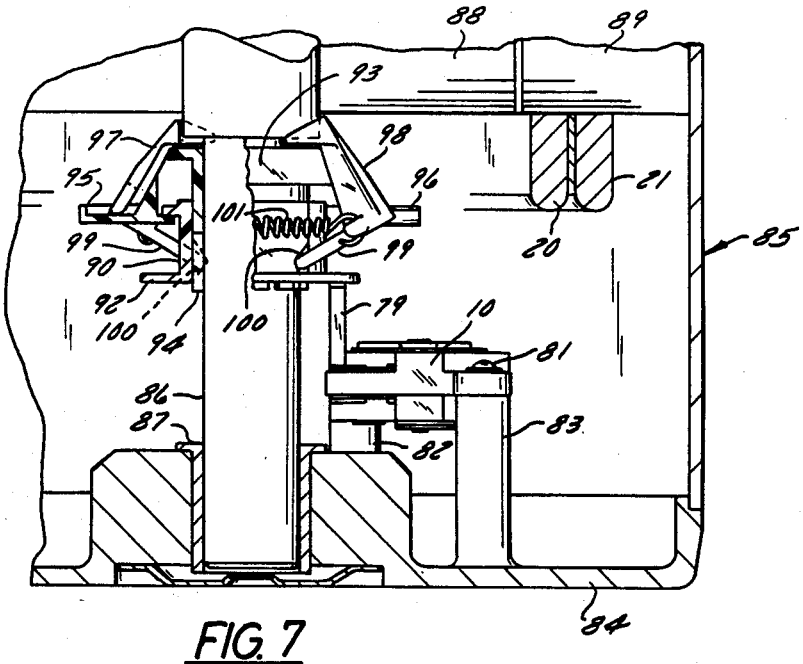
FIG. 7 shows part of the motor and rotor shaft on which there is a centrifugal device for actuating the disc that operates the control lever of the starting and reversing switch in a situation where the motor speed has decreased so the actuating disc is about to tilt the operating shaft lever to bring about a switching function.

Referring to FIG. 7, the switch base member 10 is fastened by means of machine screws 81 to mounting posts 82 and 83 which, in this particular design, are formed integrally with the end cap 84 of an electric motor 85. The motor shaft is marked 86 and is rotatable in a bushing 87. A fragment of the rotor 88 and the stator 89 are depicted in FIG. 7. Sections through one of the starting winding coils 20 and running winding coils 21 are shown.

The starting and reversing switch actuator shown in FIG. 7 is a basically conventional centrifugal force operated type which is generally designated by the reference numeral 90. It comprises a sleeve 91 which has an integral flange or disc 92 extending radially from it. The bottom of the disc is smooth. In FIG. 7, disc 92 is presently in its lowest obtainable position in which case it is holding switch operating lever 79 in a position that is angulated from vertical in a direction that depends on which direction the motor was turning when it last came to a stop. Centrifugal actuator 90 includes a body 93 that is shaped somewhat like a truncated pyramid which has an integral sleeve 94 which fits tightly on motor shaft 86. There are two wings 95 and 96 extending from pyramid shaped member 93. There are two centrifugal force actuated pivotable weights 97 and 98 which have pairs of prongs such as the one marked 99 formed integrally with them. The tips of the prongs pivot in notches 100 that are formed in the sleeve body 91. Weights 97 and 98 are compelled to pivot toward each other in opposition to centrifugal force by means of cross connecting springs, one of which, 101, is visible in FIG. 7. In that figure, it can be assumed that the motor shaft is either at rest or turning at substantially below its full rotational speed in which case the weights 97 and 98 are pulled toward each other by springs 101, causing the arms 99 on the weights to push the actuator disc 92 downwardly as viewed in FIG. 7. If the disc is rotating counterclockwise as viewed from its bottom in FIG. 7 when motor shaft rotation is slowed down by an overload, for instance, or stopped by reason of the mains switch 24 being opened, a wiping action will take place between actuating disc 92 and the tip of switch operating lever 79 which will cause the operating lever to tilt to the left as viewed from the right side of the lever in the orientation of FIG. 7. If the actuating disc 92 is turning clockwise as viewed from the bottom in FIG. 7 at the time the shaft rotational speed of the motor is substantially stopped, switch operating lever 79 will tilt clockwise as viewed from the right side in FIG. 7. As will be elaborated later, every time the operating lever 79 is tilted from neutral unactuated position to one side of what is nominally vertical to the other side, the switch blades are repositioned so that the direction of current flow through the starting winding 20 of the motor will reverse and the motor rotation will reverse concurrently. If the motor comes to a complete stop as a result of the mains switch 24 being opened, the starting and reversing switch blades will be set in such a position that the next time the motor is energized, it will rotate in a direction opposite from that which it rotated before it was deenergized.

FIG. 4 is especially useful for illustrating how the centrifugally actuated disc 92 and switch operating lever 79 relate to each other. Assume that mains switch 24 has just been closed and the motor and actuator disc 92 start running in the direction of the arrow next to the disc. The motor now comes up to full speed. Disc 92 retracts upwardly. Operating lever 79 rocks to neutral or vertical position as in FIG. 3 and contacts 38 and 53 separate and the starting winding deenergizes. Now assume the motor and disc 92 slow down to nearly or actually a stop due to load jamming of the motor or due to opening main line switch 24. Disc 92 then descends. It encounters operating lever 79 in a vertical position and, since the disc is running in the direction of the arrow as it comes to a stop, the wiping action of the disc 92 on the tip of the operating lever 79 will tilt the operating lever to the right of vertical so that contacts 39 and 64 would close. This changes the direction of current flow through the starting winding 20 and the motor begins to turn in the direction opposite of the direction it was turning at the onset. The operating lever 79 is then biased back to neutral position under the influence of the springy switch blades which tend to spring apart.

Figure 8:
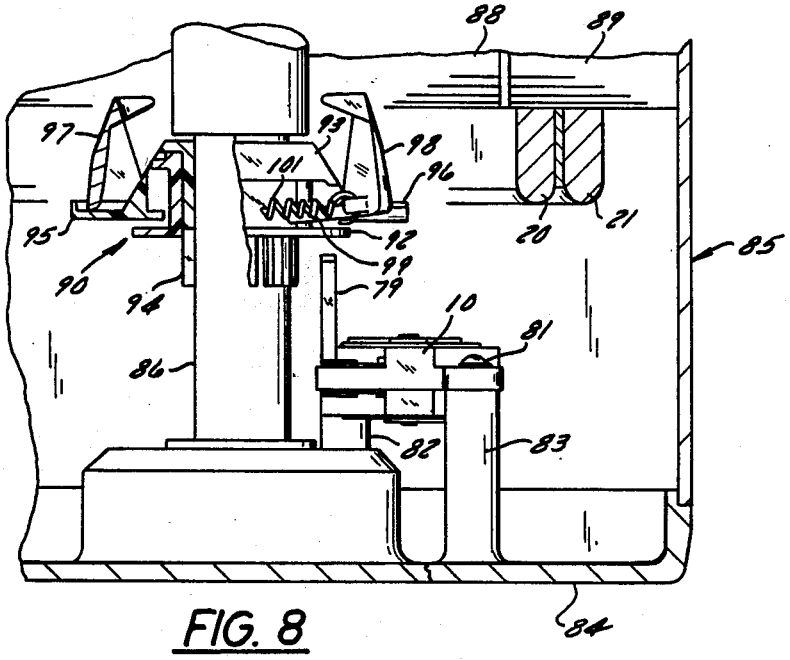
FIG. 8 is comparable to the preceding figure except that the centrifugal device is shown in a state in which it would te when the motor shaft is up to operating speed in one direction of rotation.

In FIG. 8 the assumption is that the motor is running at near or at top speed in which case weights 97 and 98 are forced radially outwardly by centrifugal force, thus causing actuator disc 92 to be retracted axially away from switch operator lever 79. This means that the operating arm 79 is in neutral and not angulated so all contacts are open for deenergizing starting winding 20 when the motor is near or at its maximum rated rotational speed. Of course, energization of the running winding 21 will be maintained as long as the main switch 24 is not opened.

Figure 9:
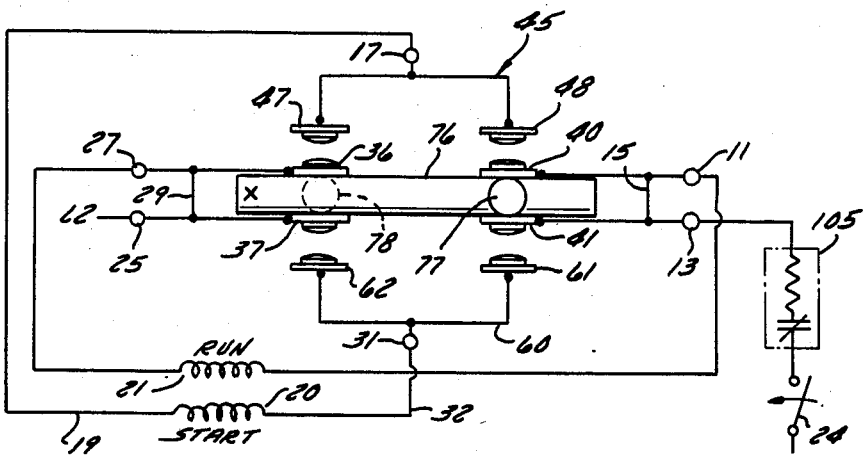
FIGS. 9–11 are diagrams for explaining the various operating sequences of the starting and reversing switch.
Figure 10:
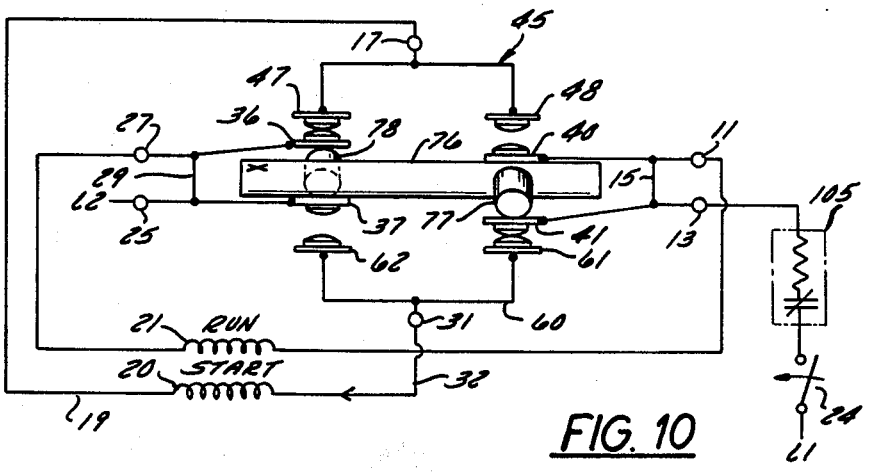
Figure 11:
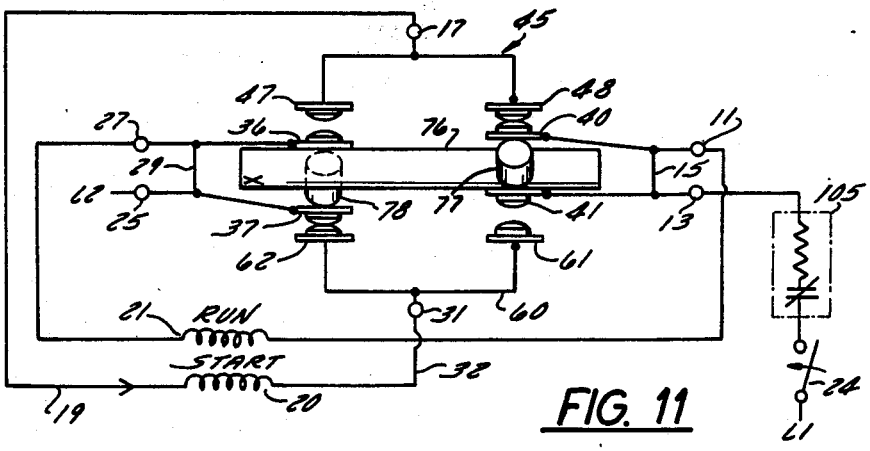

FIGS. 9–11 are diagrammatic representations of the switch assembly depicted in FIGS. 1–6. The reference numerals used in these figures correspond with those used in the other figures to identify similar items. The FIG. 9 diagram depicts the position of the switch blades when the motor is up to speed as it is in FIG. 8. At this time the main power switch 24 would be closed so as to supply power through line L1 to the switch. The switch operator arms are in neutral position. All contacts are open so the starting winding 20 is deenergized. Current flow is through overload protective device 105 to spade connector 13 which is connected to spade connector 11 by means of eyelet 15. Spade 11 connects run winding 21 of the motor between spade connectors 11 and 27. Spade connector 11 connects to power line L1 and spade connector 27 connects to power line L2 through eyelet 29. Thus the running winding 21 is connected across the power lines but the starting winding 20 is deenergized as a result of all switch blades and contacts being in opened circuit condition.

Refer now to FIG. 10 and assume that the motor has slowed down substantially due to overload or that line switch 24 has been opened so that the motor came to a stop. As the motor decelerated, the centrifugal actuator 90 attained the condition in which it is shown in FIG. 7 where the actuating disc 92 has been pushed axially downwardly so as to tilt switch operating lever 79. Thus, in FIG. 10, radial arm 78 on operator shaft 76 has turned up to cause single switch blade 36 to contact the blade 47 on the double blade 45 and the arm 77 has turned down to deflect single switch blade 41 into contact with blade 61 of double blade member 60. Assuming that the motor running winding is still fully energized as a result of mains switch 24 being closed and assuming that the motor rotational speed has decreased substantially such as might be the case if there were an overload on the motor, the running winding 21 will remain connected between power mains lines L1 and L2. When the switch contacts are set as they are in FIG. 10 as a result of the mains switch 24 being opened or as a result of substantial speed reduction, the actuator disc 92, which has been turning in a particular direction, rocks the switch operator arm 79 by a wiping action in the same direction. This sets up the contacts in FIG. 10 to cause the motor to change the current flow direction through the starting winding 20 relative to the current flow direction through the running winding 21. Now in FIG. 10 the current flow through the starting winding begins at line L1 and passes through contacting switch blades 41 and 61 for entry into the starting winding 20 in the flow direction indicated by the arrow on line 32. After passing through the starting winding the current returns to line L2 by way of line 19 and closed switch blades 47 and 36 which now connect to line L2 through eyelet 29. When the motor gets up speed in whatever direction it is compelled to run, the springiness of the switch blades causes the operator shaft 76 to return to its neutral position as in FIGS. 6 and 9.

In FIG. 11 it is assumed that the motor rotational speed has been decreased or the motor has been stopped when the switch blades were undeflected or in neutral position as in FIG. 9 and that the motor had been running in whatever direction it was compelled to start and run when the switch parts were in the condition in which they are shown in FIG. 10. This slowing or stopping will cause the centrifugally controlled actuator disc 92 to move axially and angulate switch operator lever 79 to turn the operator shaft 76 in the direction shown in FIG. 11 which is opposite to that in which it is shown in FIG. 10. Now, radially extending operator arm 78 is tilted down and operator arm 77 is tilted up in FIG. 11. Hence, single switch blade 40 has been deflected into contact with blade 48 of double blade 45. Concurrently, single blade 37 is deflected into contact with blade 62 of double blade 60. This switch operation cause starting current to flow in the opposite direction through starting winding 20 as indicated by the arrow on starting winding feed line 19. Now the current flow in the starting winding circuit is from line L1 through switch blades 40 and 48 and then out from the spade connector 17 over line 19 to the starting winding 20 and then through line 32 to spade connector 31 for continuing through closed switch contacts 37 and 62 which are connected to power line L2.

Figure 12:
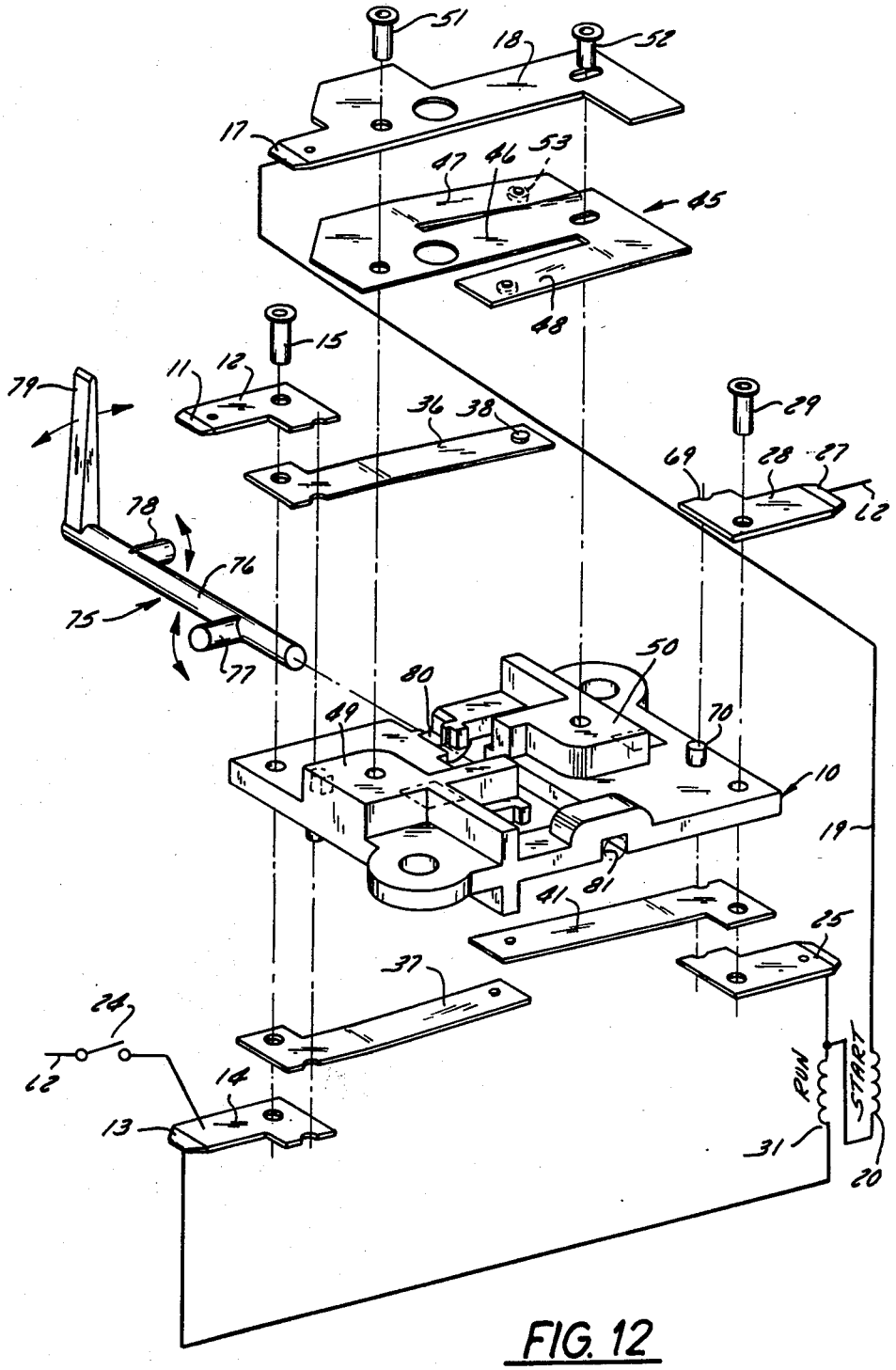
FIG. 12 is similar to FIG. 6 except that in FIG. 12 the switch is adapted for controlling a non-reversing motor such that certain parts of the switch shown in the earlier embodiment can simply be omitted to make the adaptation.

FIG. 12 shows how the switch is adapted for controlling a motor to run in a single direction. The parts depicted in the FIG. 12 embodiment are all present in the FIG. 6 embodiment but parts needed in the latter are now eliminated from the single motor direction control switch. The design makes it easy to changeover the switch assembly production line from single direction to reversing switches and vice versa. Parts inventory is minimized. As is evident in FIG. 12, several components on the top and bottom faces of the switch base 10 are eliminated and no parts had to be substituted. As in the automatic motor reversing version of the switch, in the single direction version the running winding 31 of the motor is fixedly connected between the line switch L1 spade connector 14 and spade connector 25 which is always connected to spade connector 28 and power line L2. The starting winding 20 circuit is interrupted under centrifugal force when the motor gets up to speed. This results, as in the reversing switch version, from the actuator disc 92 retracting from the operating lever 79 and the lever swinging to neutral position under the biasing force of the springy switch blades such as blades 36 and 47. The starting winding circuit starts at line L1 and connector 14 and continues through eyelet 15 to connector 12, blade 36, blade 47, support plate 18 via eyelets 51 and 52 and then to the starting winding 20 from spade connector 17 on support plate 18.

I claim:

1. A switch operable to start a single phase induction motor of the type having a rotor shaft, starting and running windings, and an actuator member rotatable with said shaft and movable to an active position in response to said motor rotating at below a predetermined speed or stopping and movable to an inactive position when said motor exceeds said predetermined speed, said switch comprising:

a base member comprised of insulating material and having nominally top and bottom faces, a pair of generally flat switch blade means mounted to said base member in superposed spaced apart relationship, at least one of said blade means being resilient and deflectable toward the other to make contact and complete an electric circuit through said starting winding of the motor, switch operator means including shaft means mounted on said base member for rotating about a predetermined axis and arm means extending radially away from said axis, said arm means being arranged adjacent said one resilient blade means on a side thereof most remote from said other blade means, said shaft means being rotatable between a neutral position wherein said arm means do not deflect said resilient one blade means into contact with said other blade means and a rotated active position wherein said arm means deflect said one blade means into contact with the other, lever means on said switch operator shaft means arranged for being engaged by said rotatable actuator member when said member is in active position and said motor is operating below said predetermined speed or stopped so as to rotate said switch operator shaft means and arm means to active position and deflect said one blade means into contact with the other to complete a circuit through said starting winding, and said actuator member being disengaged from said lever means when said motor exceeds said predetermined speed such that the reactive force of said resilient deflected one blade will restore said arm means and shaft means to neutral position so the blades will separate.

2. The switch according to claim 1 wherein said actuator member is a disc rotatable with and coaxially with said shaft means of said switch operator means and said lever means on the switch operator shaft means has a tip or free end that receives a wiping action by said disc as the disc rotates and moves into active position so that said lever means swings in the direction of rotation of said disc when the actuator disc and lever tip engage.

3. A switch for starting and automatically reversing a single phase induction motor comprised of a rotor shaft, starting and running windings, and a rotating actuator member that shifts to one position in response to the rotor shaft rotating at or near rated speed and shifts to another position in response to said shaft speed decreasing to below a predetermined speed or decreasing to a stop, said switch comprising:

a base member comprised of insulating material and having opposite surfaces, two pairs of switch blades with two deflectable blades in each pair mounted to said base member, the two blades in each pair having a space between them and being deflectable alternately in opposite directions, relatively stationary contact members for cooperating with said blades and mounted to said base member in spaced relation with said deflectable blades when said switch is unoperated, a switch operator including a shaft supported from said base member for turning, said shaft being disposed between the two blades in each pair and having one blade deflecting arm extending radially in one direction and located between the deflectable blades in one pair and having another blade deflecting arm extending radially in the opposite direction and located between the deflectable blades in the other pair, said shaft having a neutral position wherein neither arm deflects a blade and said shaft having means for being engaged by said actuator member when rotation of said member has decreased to below said predetermined speed to turn said switch operator shaft in a direction depending on the direction in which said actuator member was rotating so that one arm will turn in a direction to deflect one switch blade in one direction into contact with a cooperating stationary contact and the other arm will turn in the opposite direction to deflect an opposite blade in the other pair of deflectable blades into contact with a cooperating contact to complete a circuit through the deflected blades and said starting winding, means for connecting one side of the electric power mains in common to one pair of deflectable blades and one end of said running winding and for connecting the other side of said electric power mains in common to the other pair of deflectable blades and the other end of said running winding, and means for connecting in common two of said stationary contact members that cooperate with a corresponding blade in each pair to one end of said starting winding and for connecting in common two of said stationary contact members that cooperate with the other corresponding blades in each pair to the other end of said starting winding.

4. A switch for starting and automatically reversing a single phase motor comprised of a rotor shaft, starting and running windings, and an actuator member movable under the influence of centrifugal force that depends on the rotational speed of the shaft, said switch comprising:

a base member having nominally top and bottom surfaces, a first pair of deflectable switch blades, one nominally top blade in said pair being mounted to said base member for being deflected away from said top surface and the other nominally bottom blade being mounted to said member for being deflected away from said bottom surface, a second pair of deflectable switch blades laterally spaced from the first pair, one nominally top blade in said second pair being mounted to said base member for being deflected away from said top surface and the other nominally bottom blade in said pair being mounted to said member for being deflected away from said bottom surface, a first pair of nominally top stationary contact members mounted to said base member, one member in said first pair being spaced from and aligned with said deflectable top blade in said first pair of blades and the other contact member in the first pair being spaced from and aligned with said deflectable top blade in said second pair of blades, a second pair of nominally bottom stationary contact members mounted to said base member, one member in said second pair being spaced from and aligned with said deflectable bottom blade in said first pair of blades and the other contact member being spaced from and aligned with said deflectable bottom blade in said second pair of blades, one electric terminal means on said base member for connecting in common to both of said top stationary contact members and for connecting to one end of said motor starting winding and another terminal means on said base member for connecting in common to both of said bottom stationary contact members and for connecting to the other end of said motor starting winding, one electric terminal means for connecting in common to one side of a power main, to said first pair of deflectable switch blades and to one end of said motor running winding and another terminal means for connecting in common to the other side of said power main, to said second pair of deflectable switch blades and to the other end of said motor running winding, a switch operator including a shaft mounted to said base member for turning from a neutral position through limited opposite angles and having axially spaced apart oppositely radially extending arms disposed respectively between blades in said first and second pairs of deflectable switch blades, said shaft having means for being engaged by said movable actuator member to cause said shaft to turn, turning said shaft in one direction by said actuator in correspondence with said motor slowing down below a predetermined rotational speed causing one of said arms to deflect one of said switch blades in the first pair into contact with a top stationary contact and the other of said arms to deflect one of said switch blades in the second pair into contact with a bottom stationary contact to cause current flow in one direction through said starting winding, and turning said shaft oppositely of said one direction by said actuator causing said one arm to deflect the other one of the switch blades in said first pair into contact with a bottom stationary contact and the other of said arms to deflect the other of said switch blades in the second pair into contact with a top stationary contact to cause current flow oppositely of said one direction through said starting winding.

5. The switch according to claim 4 wherein the blades in each pair of deflectable switch blades are supported in cantilever fashion from said base member.

6. The switch according to claim 4 wherein said laterally spaced apart pairs of switch blades are parallel to each other and one blade in a pair is superimposed over the other in the same pair and said blades are mounted in cantilever fashion on said base member with the blades in the first pair extending in a direction opposite of the blades in the second pair.

7. The switch according to claim 4 wherein each of said stationary contact members is comprised of a flat portion with two integral springy blades extending in opposite directions from said flat portion and in parallelism and substantially coplanar with each other, one blade in each stationary contact member projecting parallel to one deflectable blade in said second pair.

8. The switch according to claim 7 including a rigid support plate fastened to said base member and bearing on said flat portion of the stationary contact member, said plate being shaped so that said springy blades on said stationary contact member are clear of said plate so they can flex when said deflectable blades are deflected into contact with said springy blades.

* * * * *